United States Patent [19]

Uppgren et al.

[11] Patent Number: 4,553,581

[45] Date of Patent: Nov. 19, 1985

[54] SAND MOLD MAKING MACHINE APPARATUS AND METHOD IMPROVEMENTS

[75] Inventors: John J. Uppgren, St. Paul; James W. Scott, Minneapolis, both of Minn.

[73] Assignee: FMC Corporation, Chicago, Ill.

[21] Appl. No.: 483,792

[22] Filed: Apr. 11, 1983

[51] Int. Cl.[4] ..... B22C 15/24

[52] U.S. Cl. ..... 164/16; 164/20; 164/29; 164/200; 164/243

[58] Field of Search ..... 164/29, 187, 200–202, 164/241, 243, 347, 20, 16

[56] References Cited

U.S. PATENT DOCUMENTS

| | | | |
|---|---|---|---|
| 1,354,913 | 10/1920 | McKechnie | 164/129 |
| 2,665,461 | 1/1954 | Rodgers | 164/202 |
| 3,417,811 | 12/1968 | Masi | 164/243 |
| 4,280,549 | 7/1981 | Gibbs | 164/347 |

FOREIGN PATENT DOCUMENTS

| | | | |
|---|---|---|---|
| 54-51930 | 4/1979 | Japan | 164/202 |

*Primary Examiner*—Nicholas P. Godici
*Assistant Examiner*—Richard K. Seidel
*Attorney, Agent, or Firm*—H. M. Stanley; R. B. Megley

[57] ABSTRACT

A core blowing machine receives match plates on a mounting surface so that a sand and bonding agent mixture may be packed about the match plate and exposed to a catalytic gas for forming a mold component. A support surface is disposed beneath the mounting surface. An auxiliary assembly includes an auxiliary mounting surface and an auxiliary support surface in substantially the same spatial relationship as the mounting and support surfaces. A support jack is placed on the auxiliary support surface and is adjusted in length to extend between the auxiliary support surface and a match plate mounted in the auxiliary assembly. Then the suppot jack is placed in a position on the support surface which is similar to the position occupied on the auxiliary support surface and the matching plate is disposed on the mounting surface. Indicia are provided on both the auxiliary support surface and the support surface to aid in placing the support jack in the similar position on the latter surface.

17 Claims, 6 Drawing Figures

SAND MOLD MAKING MACHINE APPARATUS AND METHOD IMPROVEMENTS

BACKGROUND OF THE INVENTION

1. Field of the Invention

This invention relates to automatic sand mold making apparatus and process, and more particularly to such apparatus and process which provide for precise reproduction of mold and core components for precision article casting.

2. Description of the Prior Art

Automatic sand mold and core making machines are available for foundry operations. One such line of machines is available from Redford Carver Foundry Supply Equipment, of Detroit, Mich. These machines are typically automated to form cores and mold components at room temperature by packing a mixture of mold sand and bonding material around a mold forming shape and by then driving a particular gas under pressure through the mold material mixture. The gas acts as a catalyst when it comes into contact with the bonding agent so that a solid sand mold component is produced. Further, an inert gas is passed under pressure through the formed sand mass to purge the catalytic gas from the sand mold component as well as from the interior of the machine prior to removing the formed mold components and cores therefrom. The pressures exerted by packing the sand around the mold forming pattern, passing the catalytic gas through the sand mass and purging the sand mass with inert gas produces a force against a plate (match plate) on which the mold pattern is mounted which may cause the plate to bend or deform in some other fashion. As a consequence, the resulting mold component will assume a shape which departs from that intended to be produced by the pattern. Moreover, if the mold component is a cope or a drag, the parting plane surface may not be flat on either the cope or the drag, whereby casting material poured into the cope and drag assembly may readily escape at the parting plane causing severe cast article cleanup problems (flashing formation) as well as dimensional aberrations in the end cast article.

SUMMARY OF THE INVENTION

The invention disclosed relates to a core blowing machine for receiving match plates which are shaped to form cores and molds for casting operations. The core blowing machine has a framework which has mounted thereon a core and mold formation mixture dispensing head, a gas blowing head, and a gassing chamber having an inlet side with an aperture therein adapted to accept a match plate and an outlet therefrom. Additional structure is attached to the framework for vertically positioning the gassing chamber between a position adjacent one of the mold mixture and gas blowing heads and a position remote therefrom. Additional structure is adapted to alternately position the mixture dispensing head and the gas blowing head in alignment with the gassing chamber aperture. Associated with the foregoing is a platform which is fixed within, spaced from and in alignment with the aperture in the inlet side of the gassing chamber. An adjustable support jack is configured to extend between the platform and one side of a match plate which is mounted in the aperture. Means is included in the support jack for adjusting the length thereof. A flask is adapted to contact the other side of the match plate and to surround the shape thereon for forming cores and molds. Means is provided for securing the flask in position on the other side of the match plate, whereby flexure of the match plate due to pressure exerted during sequential filling, gassing, and purging of the flask from the mixture dispensing and gas blowing heads is restricted.

In addition to the foregoing, a match plate support surface is provided having an aperture therein formed to accept a match plate. An auxiliary platform is attached to the support surface in alignment with the aperture and spaced substantially the same distance therefrom as the platform is spaced from the aperture in the gassing chamber. The support jack is initially disposed and adjusted to extend between the auxiliary platform and the one side of the match plate when it is mounted within the aperture in the match plate support surface. As a result the support jack may be transferred from the auxiliary platform to the platform in the gassing chamber without further length adjustment and thereby provide the desired support for the match plate.

In accordance with another aspect of the invention a method of forming cores and molds on a core blowing machine is disclosed wherein the machine is of the type which sequentially dispenses mold sand and bonding agent mixture and gaseous medium for hardening the mold mixture. A gassing chamber is mounted on the machine having an opening in one surface thereof adapted to accept a match plate, and further having a support platform therewithin aligned with the opening and spaced from the one surface. The process comprises constructing a reference surface having a match plate receiving aperture formed therein, and spacing a simulated support platform from the reference surface by substantially the same spacing which exists between the one surface of the gassing chamber and the support platform. The match plate is then positioned in the receiving aperture and against the reference surface. A support jack is adjusted to extend between the match plate and the simulated support platform. The position of the support jack on the simulated support platform is noted and the support jack is thereafter placed in a position on the support platform in the gassing chamber corresponding to the noted position. The match plate is then positioned in the opening in and resting against the one surface of the gassing chamber. The match plate in the last mentioned position is surrounded with the flask. Match plate bending deformation due to sequential dispensing of mold mixture and gaseous medium in the flask is thereby restricted by the support jack, and mold component desired surface shapes are maintained.

DESCRIPTION OF THE PREFERRED EMBODIMENTS

Figure 1:
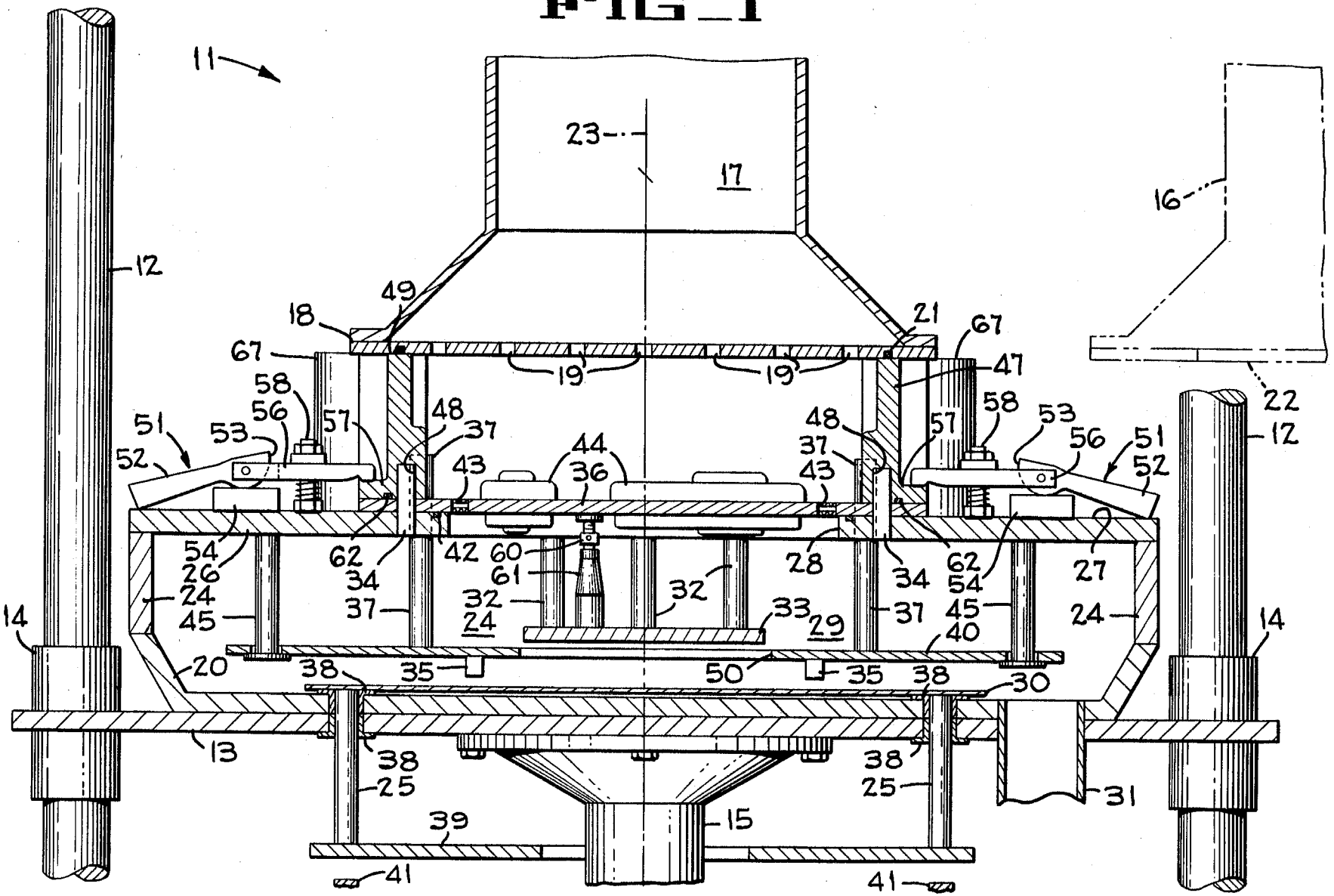
FIG. 1 is an elevation section view showing components of the present invention in association with an automatic sand molding machine.

An automatic sand mold making machine is shown generally at 11 in FIG. 1 of the drawing. The machine is utilized to make mold cores and mold components utilizing an initially free flowing mixture of mold sand and binder or bonding agent. The mixture is disposed and packed around a pattern under pressure and then exposed to an amine gas which acts as a catalyst for the bonding agent such that the sand mass is fixed or set to assume a solid fixed shape. The process utilizing a particular bonding agent and amine gas catalyst is known in the trade as the "Isocure" TM process, owned by Ashland Chemical Company of Columbus, Ohio.

The mold making machine 11 has a framework (not shown) upon which is supported four vertically extending polished rods 12 (two shown in FIG. 1). A horizontally disposed rectangular plate 13 has a bushing 14 disposed in a hole through the plate at each of four corners of the plate. Plate 13 is mounted on the machine so that one of the rods 12 extends through each of the bushings 14. In this fashion, the plate may be moved vertically on the rods 12 by a vertically movable column 15 driven by a means (not shown) for imparting upward and downward force thereto.

The mold making machine 11 also includes a mold sand and binding mixture dispensing head 16 shown in phantom lines in FIG. 1 as well as a gassing head 17 shown in solid lines in FIG. 1. The mold sand mixture head has a hopper (not shown) disposed thereabove to store a supply of mold formation mixture therein for delivery to the head 16. The gassing head 17 is coupled to an amine (catalyst) gas supply as well as to a nitrogen (inert purging) gas supply in accordance with the normal installation of such machines. The gassing head may be seen to have a plate 18 with perforations 19 therein and with a continuous seal 21 extending through a continuous groove in the bottom face thereof. The mold mixture head 16 has a similar plate 22 having an aperture therein through which a quantity of the mold sand mixture from the hopper may be forced. The heads 16 and 17 are moved on the mold making machine framework to alternately occupy a position in alignment with a centerline 23 between the vertical guide rods 12 and a position remote from the centerline. In the depiction of FIG. 1 the head 17 is shown so aligned, while the head 16 is shown disposed remotely from the centerline.

Mounted on the horizontally disposed plate 13 is a rectangular collector box 20, at the edges of which are fastened four upwardly extending sidewalls 24. An upper or inlet plate 26 is supported by the sidewalls. The inlet plate has an upper reference surface 27 and a centrally located aperture 28 therein. Sidewalls 24 and the inlet plate 26 together with the collector box 20 form a gassing chamber 29 which has an outlet pipe 31 communicating therewith through the plate 13.

Three posts 32 are shown in FIG. 1 depending from the bottom side of inlet plate 26 and fixed thereto. A support platform 33 is fixed to the lower ends of the posts so that it is positioned within the gassing chamber 29 and below and in alignment with the aperture 28 in the inlet plate. Three additional posts 32 support the end of the platform 33 not shown in the section of FIG. 1.

Figure 4:
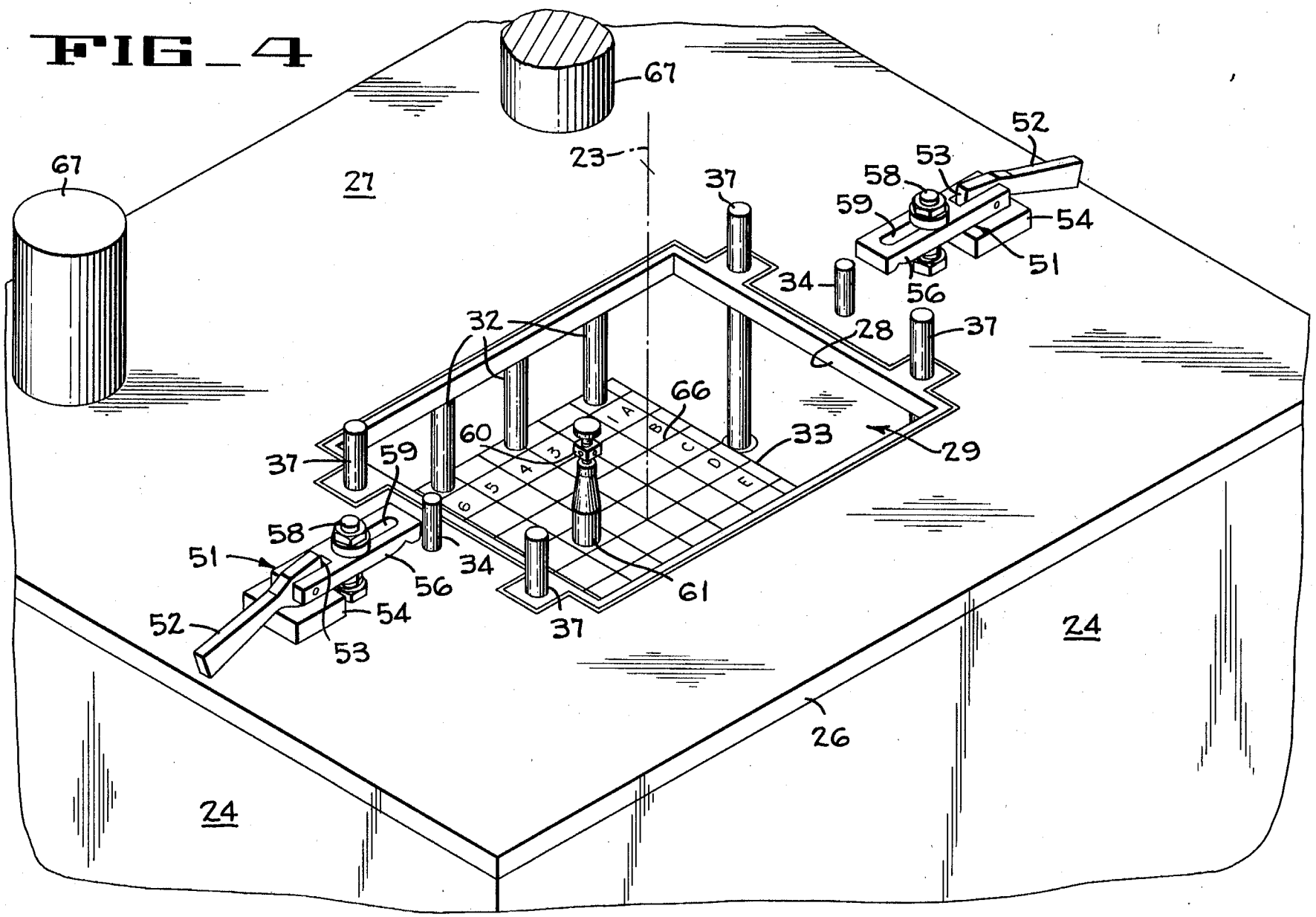
FIG. 4 is a perspective view of one side of the gassing chamber with a match plate receiving aperture therein in accordance with the present invention.

As may be seen with reference to both FIGS. 1 and 4, a guide pin 34 is fixed in the inlet plate 26 extending upwardly from the reference surface 27 on each side of the aperture 28. The guide pins are positioned so that they will accept a series of match plates such as the one shown at 36 (FIGS. 1 and 5) and thereby correctly position the match plates in the aperture 28 and on the surface 27. The reference surface 27 serves as a primary support surface for the match plates. The match plates are often made of aluminum with a pattern for a cope on one side and a drag on the other. The aluminum, having a low modulus of elasticity (about $10^6$ pounds/sq. inch), tends to bend when a net force is exerted against one side thereof.

Also shown in FIGS. 1 and 4 is a pattern of four upwardly extending ejector pins 37. The ejector pins pass through bushings (not shown) in the inlet plate 26 and are free to move vertically in unison relative to the reference surface 27. Any adequate means may be used to cause the motion of the ejector pins 37, but a simple structure for accomplishing such motion is shown in FIG. 1. Four actuator pins 25 (two shown) extend through gas tight bushings 38 in the horizontally disposed plate 13 and the collector box 20 and are all fixed at the lower ends thereof to an actuator plate 39. Fixed stops 41 are attached to the framework of the mold making machine as seen in FIG. 1 so that when the plate 13 is lowered on the rods 12, the plate 39 will rest on the stops and prevent lowering of the actuator pins. A plate 30 is fixed to the top ends of the actuator pins. Consequently, the gassing chamber 29 will be lowered relative to the plate 30 and a number of depending rod members 35 will be contacted by the plate 30. The rod members 35 are fixed to an ejector pin plate 40 which may move in a vertical direction on guides 45 fixed within the gassing chamber 29. The ejector pins 37 are fixed in the ejector pin plate which has an opening 50 therein so that it may rise above the platform 33 and thereby lift the ejector pins through a distance of approximately 3 to 5 inches. It is again emphasized that the manner of providing for movement of the upper end of the ejector pins relative to the reference surface 27 is not limiting in the instant invention, there being only a requirement that a mechanism for accomplishing this function be included whether it be actuated hydraulically, electrically or otherwise. It may also be seen in FIGS. 1 and 4 that a continuous seal 42 is placed in the reference surface 27 surrounding the aperture 28 in the inlet plate 26 and also encompassing the ejector pins 37.

Figure 5:
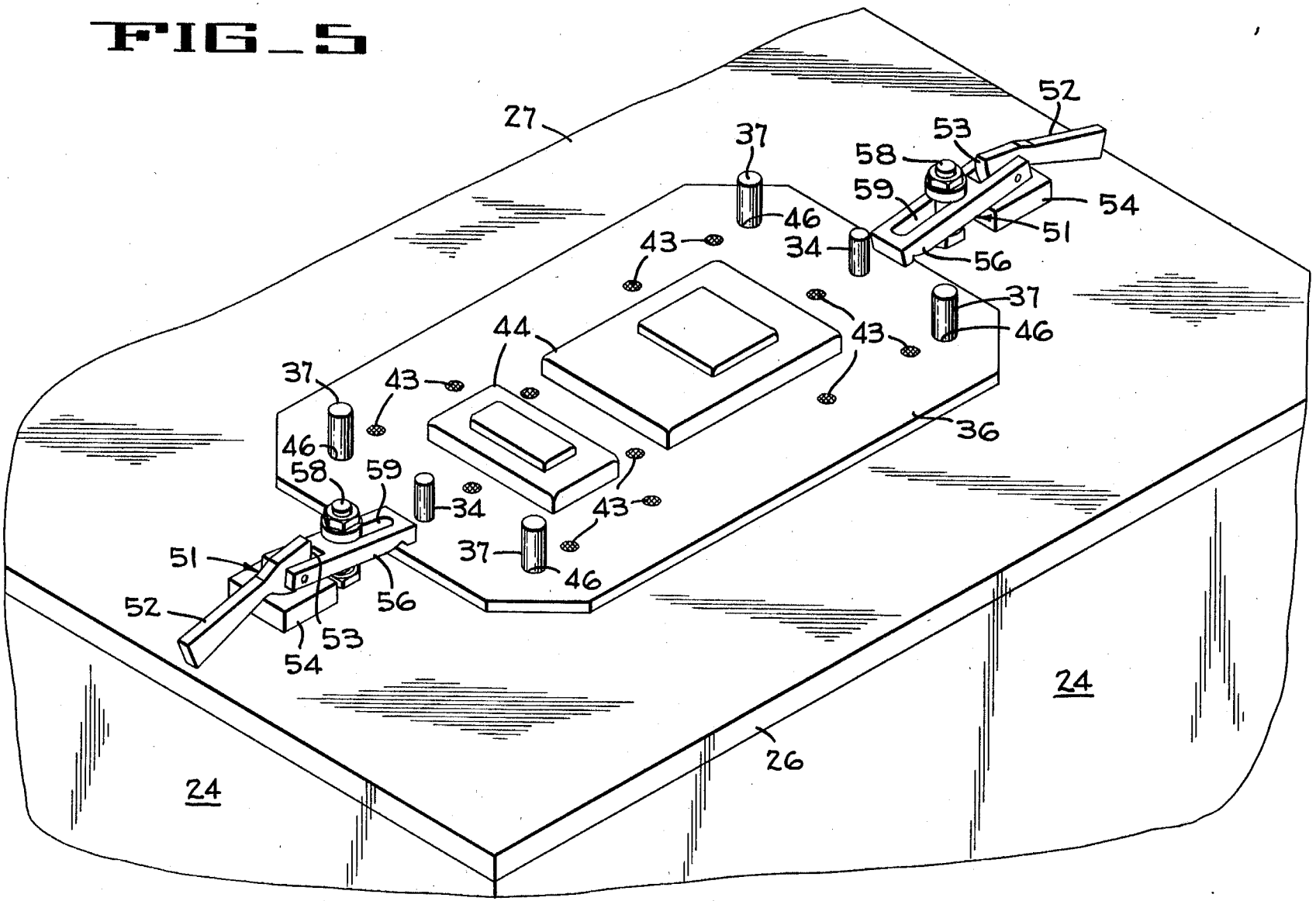
FIG. 5 is a perspective view of the apparatus of FIG. 4 with a match plate mounted within the opening.

The continuous seal 42 is contacted by the bottom side of a match plate mounted on the reference surface 27 as seen in FIGS. 1 and 5. The match plate has a series of screened perforations 43 therein to allow gaseous medium to pass through the match plate while blocking passage of mold mixture granules. The match plate may be seen to have a pattern 44 thereon which will determine the surface shape of a mold made therefrom. The match plate also has holes 46 therethrough (FIG. 3) in a pattern which is in registration with the ejector pins 37 so that the ejector pins may freely pass therethrough (FIG. 5).

Figure 6:
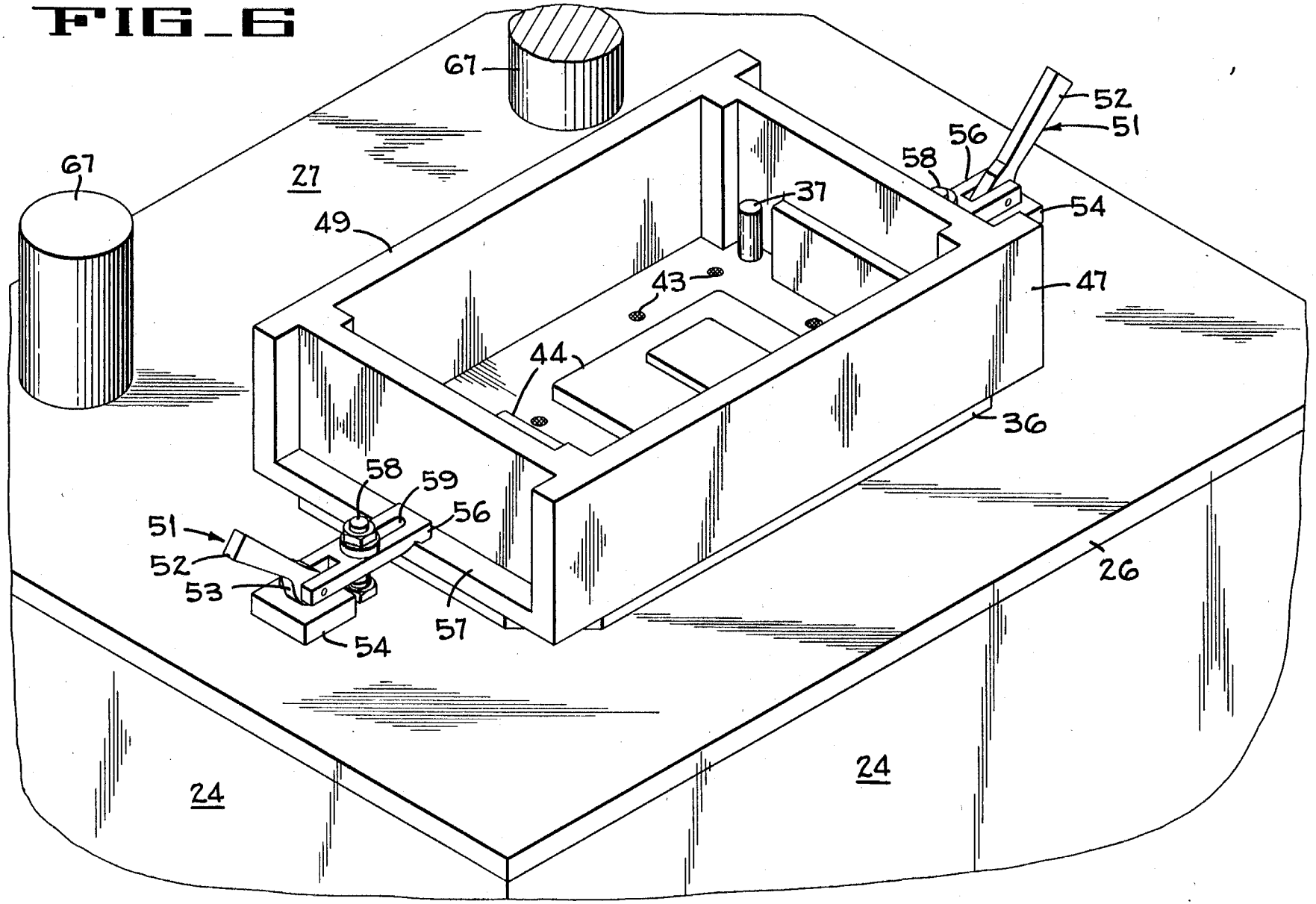
FIG. 6 is a perspective view showing the apparatus of FIG. 5 with a mold forming flask mounted in fixed position thereon.

FIG. 6 shows a flask 47 positioned on top of the match plate 36 and surrounding the pattern 44 on the top side of the match plate. The position of the flask is registered on the guide pins 34 as the pins enter a pair of blind holes 48 through the bottom surface of the flask as seen in FIG. 1. The ejector pins 37 are seen to extend into the enclosure created by the flask walls. The walls of the flask have a three to five degree upwardly opening draft so that mold components and cores formed within the flask may be pushed upwardly by the ejector pins 37 and freely removed from the flask thereafter. It should also be noted that the flask 47 is of unitary construction, there being no joints or junctions between the adjacent wall sections. Therefore, the flask is gas tight at the corners thereof. A flat planar surface 49 is formed at the top of the flask which may be seen in FIG. 1 to bear against the continuous seal 21 hereinbefore described in conjunction with the plates 18 and 22 on the gassing head 17 and the mold mixture head 16 respectively. As may also be seen in FIG. 6, a pair of commercially available latches, shown generally at 51, are mounted on the reference surface 27, one on each side of the aperture 28. The latches are hand actuated by means of a handle 52 which causes a cam end 53 to bear against a cam block 54 and to bring the opposite end of an engaged lever 56 to bear against a ledge 57 on the flask 47 as the lever pivots about a fulcrum bolt 58 when the handle is raised. An elongate opening 59 in the lever 56 allows the lever to be withdrawn to an out-of-the-way position for assembling and disassembling the flask and match plate onto guide pins 34 and the reference surface 27.

Referring once again to FIG. 1 of the drawings, an adjustable support jack 61 is seen supported on the platform 33. Structure such as the threaded shank and rotatable shank engaging block combination 60 is provided on the support jack. The support jack is adjusted in height by rotational adjustment of the engaging block in structure 60, so that it extends between the upper surface of the platform 33 and the lower surface of the match plate 36. The height of the jack 61 is therefore adjusted substantially to extend over the distance between the reference surface 27 and the upper surface of the platform 33. With the jack installed as shown in FIG. 1, the flask 47 may be filled from the mold mixture head 16 by driving the mold mixture down into the flask with pneumatic pressure. Subsequently the head 16 is moved away from the centerline 23 and the gassing head 17 is moved into alignment with the centerline. Amine gas under a relatively low pressure is introduced into the loose mold sand and binder mixture for a predetermined amount of time according to the aforementioned Isocure TM process. The low pressure phase is followed by a high pressure shot of amine gas. Inert gas such as nitrogen is thereafter introduced through the gassing head 17 under pressure and the amine gas is driven out of the gassing chamber 29 through the outlet pipe 31 to a gas scrubber (not shown).

It should be noted that during the aforedescribed mold mixture filling and gassing steps that the respective head is placed in tight pressure contact with the upper surface 49 of the flask 47 so that the continuous seal 21 eliminates any mold mixture or gas transit across the top of the flask. Moreover, a continuous seal 62 is present in the bottom surface of the flask 47, as seen in FIG. 1, so that gas cannot escape between the mating surfaces of the flask and the match plate 36. The continuous seal 42 prevents escape of gas between the bottom surface of the match plate and the reference surface 27. Therefore, it may be seen that a gas impervious path is provided between the gassing head 17 and the gassing chamber 29, and that the pressure exerted downwardly in FIG. 1 on the match plate 36 during the various aforedescribed steps will not cause the match plate to deform in a downwardly bending mode because of the support provided to the match plate by the jack 61. As a result the bottom surface of the mold component formed by the match plate retains its planar characteristic so that it may match with a mating mold component formed by the opposite side of the match plate 36. The two planar surfaces therefore mate in substantially contiguous fashion thereover. If the surfaces do not mate well at the parting line, metal will run out of the mold during casting. The dimensional characteristics of the cast article will also suffer.

All of the foregoing advantages are supplemented by the fact that the structure and process disclosed herein provides for quick interchangeability of match plates on the mold making machine. As a result small production runs of mold components and cores may be interspersed within larger production runs of different mold components and cores with minimal time expenditures for changeover as described herein.

It should be recognized, with reference to FIG. 1, that the support jack could be adjusted to an appropriate height to extend between the top surface of the platform 33 and the bottom surface of the match plate so that the jack contacts both surfaces and provides support for the match plate to resist bending, by adjusting the jack to a height which is greater than the distance from the top of the platform to the point of contact on the match plate initially. Thereafter the match plate is placed on the guide pins 34 until contact between the top end of the jack and the match plate is felt. The match plate is then removed and the height of the jack is adjusted to a slightly lesser dimension. These last two steps are repeated until contact between the match plate and the top of the jack is just made with the match plate resting on the reference surface 27 and positioned by the guide pins 34. Such a procedure would require considerable time due to the repeated removal and installation of the match plate on the guide pins, and the sequence of height reductions undertaken with the support jack.

Figure 2:
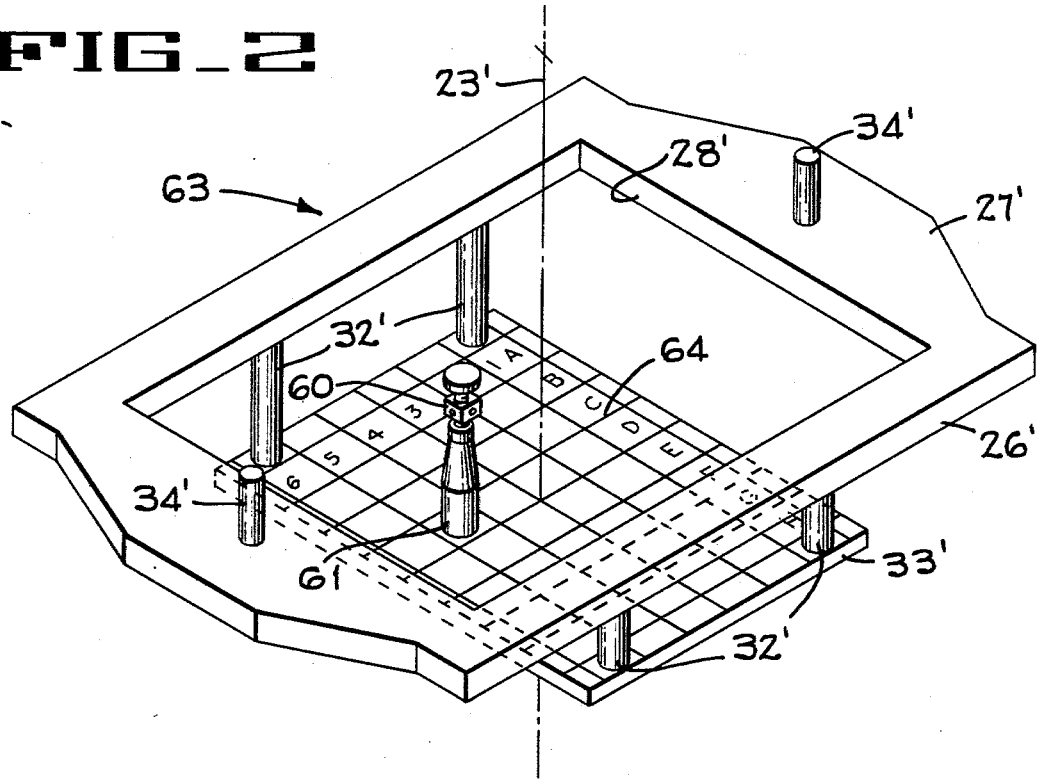
FIG. 2 is a perspective view of an auxiliary support surface and platform in the present invention.

While the apparatus shown in FIG. 1 and the process just described for obtaining support for the match plate is operable to obtain the desired end results, the apparatus as shown in FIG. 2 and the process described in conjunction therewith provides a convenience in obtaining the desired end results. A jig 63 is shown in FIG. 2 wherein primed item numbers designate structural components which function similarly to like item numbers seen in FIGS. 1 and 4 through 6. A match plate support plate 26' has an upper reference surface 27'. A pair of guide pins 34' are positioned in the support plate on opposite sides of an aperture 28' in the support plate and in the same position relative to the aperture as the guide pins 34 have to the aperture 28 (FIG. 4). A pair of support posts 32' are fixed to and depend from the lower surface of the support plate 26'. The support posts are of a length such that when an auxiliary platform 33' is fixed to the lower ends thereof, the distance from the upper surface of the auxiliary platform to the reference surface 27' is the same as the distance from the upper surface of the platform 33 to the reference surface 27. The upper surface of the support plate 33' has a grid 64 inscribed thereon with orthogonally extending indicia as seen, wherein letters A through H extend in one direction and numbers 1 through 6 extend orthogonally therefrom. A centerline 23' extends vertically through the auxiliary assembly 63 in the same relation thereto as the centerline 23 occupies with the assembly including the surface 27 and aperture 28 of FIG. 1. The adjustable support jack 61 is shown resting on the grid 64 at position D5 in FIG. 2.

A grid 66 is shown on the upper surface of the platform 33 in FIG. 4 which is similar to the grid 64 seen in the auxiliary assembly 63 of FIG. 2. As described for the grid 64, the grid 66 has positions A through H designated in one direction thereon and positions 1 through 6 designated in a direction oriented orthogonally thereto. The jack 61 may be seen in FIG. 4 to be placed in position identified as D5 in FIG. 4, similar to the position the support jack occupies in FIG. 2.

Figure 3:
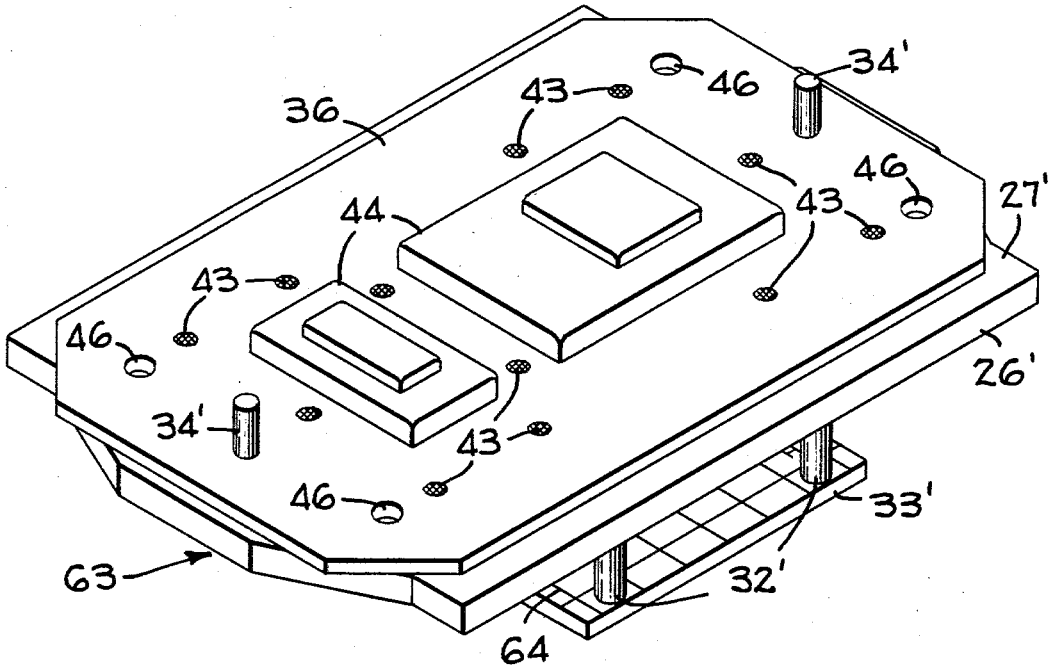
FIG. 3 is a perspective view of the apparatus of FIG. 2 with a match plate mounted thereon.

With reference now to FIG. 3, a match plate 36 is mounted on the auxiliary assembly 63, positioned thereon by the guide pins 34'. The match plate 36 therefore overlies the aperture 28' and rests upon the surface 27'. An operator may now manually place the support jack 61 underneath the match plate and in position so that when the support jack is extended it will contact the underside of the match plate at a position where it will provide support therefor. The operator may then proceed to extend the support jack in height until it contacts the match plate with the upper end thereof while the lower end rests on the upper surface of the auxiliary platform 33'. The match plate 36 is then lifted from the position seen in FIG. 3 and the position of the support jack 61 on the grid 64 is noted (FIG. 2). The support jack is then transferred from the upper surface of the auxiliary platform 33' to a position on the upper surface of the platform 33 which corresponds to the noted position (FIG. 4). By way of example, the support jack is seen in position D5 on grid 64 in FIG. 2 and is transferred to the position D5 on grid 66 in FIG. 4.

The match plate 36 is then positioned on the reference surface 27 by the guide pins 34 as seen in FIG. 5. The latch levers 56 are withdrawn from a position overlying the match plate and the flask 47 as located on the guide pins 34. Levers 56 are moved back to a position overlying the ledge 57 on the flask and the handles 52 are raised to the position shown in FIG. 6. The flask and match plate are thereby fixed in position, and further a positive seal is effected between the flask and the match plate by the continuous seal 62 and between the match plate and the reference surface 27 by means of the continuous seal 42. Having thus arrived at the configuration shown in FIG. 6, the mold sand and binder mixture dispensing head 16 and the gassing head 17 may be brought into position to sequentially dispense mold mixture and gas into the volume defined by the flask and the match plate as hereinbefore described. Mechanical stops may be seen at 67 in FIGS. 1 and 4 through 6 so that the mold mixture and gassing heads are allowed to approach the assembly of FIG. 6 only far enough to effect a positive seal at the continuous seal 21 between the plates 22 or 18 on the heads and the planar surface 49 at the upper edge of the flask 47.

It should be noted that while only one support jack 61 has been shown herein to support and thereby restrict bending in a match plate mounted on the surface 27, that a plurality of such support jacks may be used to support various points on a match plate. Rigidity is thereby provided in the match plate during the aforementioned pressurized mold formation steps so that the mold components and cores will retain the dimensional integrity of the undeformed match plates.

Although the best mode contemplated for carrying out the present invention has been herein shown and described, it will be apparent that modifiation and variation may be made without departing from what is regarded to be the subject matter of the invention.

What is claimed is:

1. In a core blowing machine for receiving match plates shaped to form cores and molds for casting operations and having a framework, a core and mold formation mixture dispensing head, a gas blowing head, a gassing chamber having an inlet side with an aperture therein adapted to accept a match plate and having an outlet therefrom, structure attached to the framework for vertically positioning the gassing chamber between a position adjacent one of the mold mixture and gas blowing heads and a position remote therefrom, and further structure adapted to alternately position the mixture dispensing head and the gas blowing head in alignment with the gassing chamber aperture, the improvement comprising a platform spaced from and in alignment with the aperture in the inlet side of the gassing chamber, means for fixing said platform in position relative to the aperture, support means configured to extend between said platform and one side of a match plate mounted in the aperture, means included in said support means for adjusting the length thereof, a flask adapted to contact the other side of the match plate and to surround the shape thereon, means for securing said flask in position on the other side of the match plate, whereby flexure of the match plate during sequential filling, gassing, and purging of the flask from the mixture dispensing and gas blowing heads is restricted, an auxiliary support assembly including a match plate support surface having an aperture therein formed to accept a match plate, and an auxiliary platform attached to said support surface in alignment with said aperture and spaced substantially the same distance therefrom as said platform is spaced from the aperture in the gassing chamber, whereby when said support means is adjusted in length and disposed initially to extend between said auxiliary platform and the one side of the match plate when it is mounted within the aperture in said match plate support surface, said support means may be thereafter transferred from said auxiliary platform to said platform in the gassing chamber to support the match plate in the gassing chamber aperture without further length adjustment.

2. The improvement of claim 1 together with indicia on said platform and said auxiliary platform for describing the position of said support means thereon relative to the match plate.

3. In combination with a core blowing machine wherein a match plate configured to allow passage of gas therethrough is positioned so that a mass of sand and bonding agent mold mixture may be disposed against a pattern face thereon, and wherein a mold mixture dispensing head and a gassing head are mounted thereupon for alternate movement into and out of position to dispense and gas the mold mixture about the match plate, a gassing chamber having an inlet side with an opening therein formed to accept the match plate, means for positioning said gassing chamber between a charging position where mold mixture dispensing and gassing may occur and a remote position, a platform in said gassing head being spaced from said inlet side away from the mold mixture and gassing heads, means for suspending said platform in position within said gassing head, means extending between said platform and a match plate in said opening for supporting the match plate therein, means for adjusting the length of said means for supporting, a flask mounted in position to surround the pattern face, means for securing said flask in position, whereby a mold component may be formed by sequentially filling said flask from the mold mixture dispensing head and gassing the filled flask from the gassing head, and an auxiliary platform assembly comprising a match plate support surface having an auxiliary opening therein adapted to receive a match plate, and an auxiliary support platform spaced from said support surface by substantially the same distance as said platform is spaced from said gassing chamber inlet side, so that a match plate may be placed in said auxiliary opening and said means for supporting may be adjusted to extend between said auxiliary support platform and the match plate, whereby the match plate and means for extending and for supporting may be positioned similarly within said opening in said gassing chamber and on said platform to provide match plate support within said opening without readjustment.

4. The combination of claim 3 wherein said flask comprises a unitary walled enclosure, said walls having a draft to enable convenient removal of a formed mold component therefrom.

5. The combination of claim 3 wherein said gassing chamber further comprises an outlet so that accumulated gas in the gassing head may be purged from the system following mold gassing.

6. The combination of claim 3 comprising first means for sealing between said flask and the match plate, and second means for sealing between the match plate and said gassing chamber inlet side.

7. The combination of claim 5 comprising first means for indicating the position of said support means on said auxiliary support platform after adjustment, and second means for indicating position for said support means on said platform, said first and second means for indicating being similar, whereby said support means similar positioning is obtained.

8. A method of forming cores and molds on a core blowing machine of the type which sequentially dispenses mold sand and bonding agent mixture and gaseous medium for hardening the mold mixture, wherein a gassing chamber is mounted on the machine having an opening in one surface thereof adapted to accept a match plate, and further having a support platform therewithin aligned with the opening and spaced from the one surface, comprising the steps of constructing a reference surface having a match plate receiving aperture therein, spacing an auxiliary support platform from the reference surface by substantially the same spacing between the one surface of the gassing chamber and the support platform, positioning the match plate in the receiving aperture and against the reference surface, adjusting the length of a support jack to extend between and substantially conform in length to the distance between the match plate and the auxiliary support platform, noting the position of the support jack on the auxiliary support platform, placing the support jack in position on the support platform in the gassing chamber corresponding to the noted position, positioning the match plate in the opening in and against the one surface of the gassing chamber, and surrounding the match plate in the last mentioned position with a flask, whereby match plate bending deformation due to sequential dispensing of mold mixture and gaseous medium in the flask is restricted by the support jack, and mold component desired surface shapes are maintained.

9. A method as in claim 8 wherein the step of surrounding comprises the step of latching the flask in place.

10. A method as in claim 8 together with the step of ejecting the mold component from the flask.

11. A method as in claim 8 wherein the steps of adjusting, noting and placing comprise the steps of adjusting a plurality of support jacks, noting the position of each of the plurality of jacks on the simulated support platform, and placing the plurality of support jacks at their respective corresponding positions on the support platform in the gassing chamber, whereby increased resistance to match plate bending deformation is obtained.

12. A method of diminishing deformation of mold cores and components during formation on a mold core and component forming machine which sequentially pressure fills, gases and purges a confined volume of sand and binding agent mixture, wherein the machine has a reference surface adapted to mount and locate a perforate match plate within an aperture in the reference surface so catalytic and purging gases may be passed through the sand volume, comprising the steps of mounting a support surface in spaced position below the aperture, constructing an auxiliary fixture having a fixture surface with an aperture therein similar to the aperture in the reference surface, spacing a fixture platform from the fixture surface in alignment with the aperture therein and parallel thereto, adjusting the length of the support member to extend between and substantially conform in length to the distance between the fixture platform and the match plate mounted on the fixture surface within the aperture thereon, noting the position of the support member on the fixture platform, positioning the support member on the support surface in substantially the same position thereon as the noted position, mounting a flask on the located match plate, and sealing the adjacent surfaces between the flask and match plate and the match plate and reference surface on lines surrounding the aperture, whereby the sequential pressure filling, gassing and purging of the volume of sand and binding agent mixture above the match plate and within the flask is prevented from causing substantial bending distortion in the match plate.

13. A method as in claim 12 wherein the step of supporting comprises the steps of adjusting the lengths of a plurality of support members to extend between positions on the support surface and a respective plurality of positions on the located match plate.

14. Apparatus for supporting a match plate shaped to form cores and mold components, wherein one side of the match plate is subjected to substantial pressure during disposal and fixing of an initially free flowing sand and bonding agent mixture thereagainst, comprising a primary planar support surface having an opening therein adapted to accept a match plate, means on said primary support surface for locating the match plate relative to said opening, a support platform in spaced relationship with and on one side of said support surface and in alignment with said opening, means for fixing said support platform in said spaced and aligned position with said opening, support means configured to extend between said support platform and the one side of the match plate, means for adjusting the length of said support means, an auxiliary support assembly including a match plate support surface having an aperture therein formed to accept a match plate, an auxiliary support platform attached to said support surface in alignment with said aperture and spaced substantially the same distance therefrom as said platform is spaced from the aperture in the gassing chamber, so that when said support means is adjusted in length and disposed initially to extend between said auxiliary platform and the one side of the match plate when it is mounted within the aperture in said match plate support surface, said support means may be transferred from said auxiliary support platform to said support platform without further length adjustment, and a flask adapted to contain the initially free flowing sand and bonding agent mixture disposed against the one side of the match plate, whereby quick interchangeability of supported match plates in said opening is facilitated for quick change of mold components being formed.

15. Apparatus as in claim 14 together with a core and mold ejector movable relative to the match plate and surrounded by said flask, and wherein said flask has walls with upwardly opening draft, whereby the cores and molds may be removed from the top of said flask.

16. Apparatus as in claim 14 together with indicia on said support platform and said auxiliary support platform for describing the position of said support means thereon relative to the match plate.

17. In a mold forming system for minimizing bending of a match plate subjected to pressure loading during the mold forming process, the combination of:

means defining first and second match plate support surfaces having openings therein adapted to receive a match plate, means defining first and second platforms having functionally identical first and second grids inscribed on their upper surfaces, first and second means for supporting said first and second platforms respectively in a position disposed a predetermined distance below said respective first and second match plate support surfaces, alignment means for aligning the match plate in said openings in the same position relative to said first and second respective grids when supported on said first and second platforms, jack means positionable at a selected position on said second grid, means for adjusting the length of said jack means, whereby said jack means is adjustable to engage the match plate on said second support surface prior to supporting pressure loading, said jack means thereafter being positionable in the same selected position on said first grid prior to mounting the match plate on said first match plate support surface, means defining side walls of the mold operatively coupled to the match plate when the match plate is disposed on said first support surface, and means for directing molding sand into the mold defined by said side wall means and the match plate, whereby said jack means minimizes bending of the match plate.

* * * * *